United States Patent [19]

Davis

[11] 4,078,785

[45] Mar. 14, 1978

[54] SHEET HANDLING APPARATUS

[75] Inventor: William A. Davis, Wickliffe, Ohio

[73] Assignee: Addressograph-Multigraph Corporation, Cleveland, Ohio

[21] Appl. No.: 738,608

[22] Filed: Nov. 3, 1976

Related U.S. Application Data

[62] Division of Ser. No. 590,396, Jun. 25, 1975, abandoned.

[51] Int. Cl.[2] ..... B65H 39/02

[52] U.S. Cl. ..... 270/58; 270/18

[58] Field of Search ..... 101/229-232, 101/262; 270/58, 18; 271/185-186; 226/197

[56] References Cited

U.S. PATENT DOCUMENTS

| | | | |
|---|---|---|---|
| 1,469,168 | 9/1923 | Mets | 271/186 X |
| 3,548,783 | 12/1970 | Knapp | 226/197 |
| 3,774,902 | 11/1973 | Schulze | 270/58 |
| 3,954,213 | 5/1976 | Andersen | 226/197 |

*Primary Examiner*—Edgar S. Burr
*Assistant Examiner*—A. Heinz
*Attorney, Agent, or Firm*—Russell L. Root

[57] ABSTRACT

A duplicator is provided having a printing couple for printing on one face of a copy sheet and a collator for collating the copy sheets as they issue from the printing couple, the paper feed paths of the printing couple and the collator being arranged substantially normal to each other. The duplicator also includes special sheet handling means for passing the copy sheet from the printing couple to the collator and also inverting the sheet. The copy sheet is advanced in a first path and direction away from the printing couple and is advanced in a second path substantially normal to the first path in a second direction towards the collator. The sheet handling means comprises a sheet turn-over device positioned to intersect the copy sheet paths for receiving and progressively inverting the copy sheet as it is advanced in the first path and simultaneously directing the sheet from the first to the second path.

1 Claim, 4 Drawing Figures

SHEET HANDLING APPARATUS

CROSS REFERENCE

This application is a division of copending application Ser. No. 590,396, filed June 25, 1975, now abandoned.

BACKGROUND OF THE INVENTION

In the printing and duplicating field there are various applications where a copy sheet printed by a printing couple is advanced to a collator for collecting booklets with the sheets in proper order.

While in some instances applications such as the foregoing have been normally handled heretofore by arranging the printing couple and the collator in straight-line tandem, such tandem arrangements impose certain limitations which restrict the use of the equipment to specific applications. In this situation, because the duplicated sheets are delivered to the pockets of the collator printed-side-up, unless the machine operator runs all of the duplicating masters, comprising a complete set of material to be printed and collated, in reverse order, i.e., last page of the set first and first page of the set last, the sheets are delivered to the collator in reverse order. Therefore, before binding the collated set of sheets it is necessary to manually reverse the order of the sheets in the set to arrange the page numbers of the sheets in proper numerical sequence.

Further, when the printing couple and collator are arranged in tandem, the overall size of the combined units is extended considerably thereby requiring substantial floor space and precluding the use of such equipment in small size work areas. Also, when the units are arranged in tandem the machine operator does not have ready access and is not within easy reach of the units and the controls therefor to perform any operations or adjustments that might be required during machine operation.

SUMMARY OF THE INVENTION

The invention provides a duplicating machine including a sheet handling means for passing a copy sheet advancing from a printing couple in a first path and direction to a second path substantially normal to the first path along which the sheet advances in a second direction to a collator device. As the sheet is passed from the first to the second path it is also inverted while maintaining the advancement of the sheet in the second path in a direction of a lead end of the sheet corresponding to the lead end of the sheet advanced in the first path.

The sheet handling means comprises a sheet turn-over device of semi-tubular configuration having an axis, and the device is mounted at a position such that the axis intersects the paths with an open face of the semi-tubular device facing the printing couple and the collator. The device receives and progressively inverts the sheet as it is advanced in the first path from the printing couple and simultaneously directs the sheet from the first to the second path for advancement to the collator. Preferably, an air blower device is associated with the sheet turn-over device to prevent smudging of the inked image on a sheet printed on both sides when the sheet is being inverted and passed from the first to the second path so that the entire organization is especially equipped to successfully handle sheets, having surface conditions such as partially dried ink images, which make necessary minimum rubbing contact during transport.

Because the paths are substantially normal to each other, the printing couple and collator may be arranged in an L-shaped configuration to provide a combined unit substantially more compact than the conventional tandem units. This arrangement also disposes the machine controls and operations to be performed within easy reach of the machine operator such that they are readily accessible to the operator from a common location, thereby reducing the amount of walking normally required by the machine operator when operating conventional tandem equipment.

It is an object of the present invention to provide an improved sheet turn-over device, for use in combination with a duplicating machine having a printing couple and a collator, for passing a copy sheet from one to the other and also inverting the sheet at the same time.

Another object is to provide a semi-tubular sheet turn-over device, having an axis intersecting a first and a second copy sheet path and an open face thereof facing the printing couple and the collator in the two respective paths, for receiving and progressively inverting the sheet advanced in the first path away from the printing couple and simultaneously directing the sheet from the first to the second path towards the collator.

Another object is to provide a sheet turn-over device of such character that after turn-over the copy sheet proceeds along its path with the same edge in leading position as occupied the leading position before turn-over.

A feature of the invention is to provide a sheet turn-over device which is simple in construction, inexpensive to produce and reliable in operation.

Other objects, features and advantages of the invention will appear hereinafter as the description proceeds.

IN THE DRAWING

DESCRIPTION OF THE PREFERRED EMBODIMENT

Figure 1:
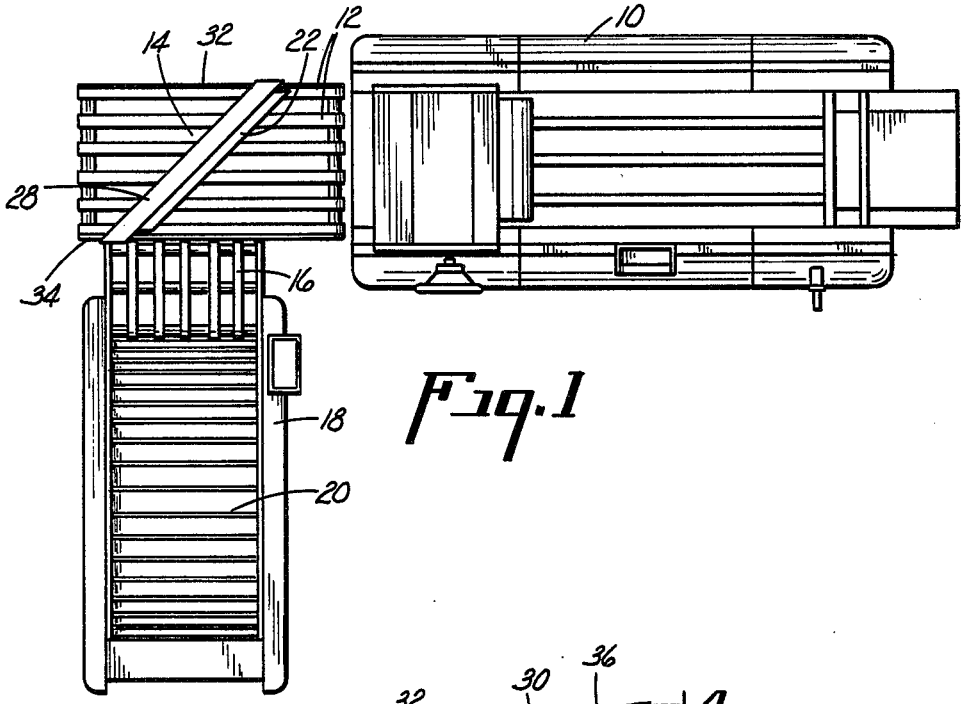
FIG. 1 is a schematic plan view of a duplicator arrangement including a printing couple and a collator in association with a sheet turn-over device for passing a copy sheet from the printing couple to the collator in accordance with the present invention.

With reference to FIG. 1 there is shown a duplicating machine embodying a printing couple 10, a first conveyor 12 for advancing a copy sheet from the printing couple 10 to a sheet handling or turn-over device indicated generally by the reference character 14, and a second conveyor 16 normal to the first conveyor 12 for advancing a copy sheet from the turn-over device 14 to a sheet distributor or collator 18 provided with a plurality of sheet receiving pockets 20. Although the conveyors 12 and 16 may be of any suitable type, for purposes of this disclosure the conveyors are shown as being endless belt conveyors in which the belts are driven by any suitable power source, not shown in the drawing.

The first and the second conveyors 12 and 16 respectively, define first and second paths respectively. A copy sheet is advanced in a first direction in the first path away from the printing couple 10, is received and progressively inverted by the sheet turn-over device 14, and advanced in a second direction in the second path substantially normal to the first path towards the collator 18. The copy sheet is advanced in the first path, inverted and advanced in the second path while maintaining the same edge of the copy sheet in lead position.

Figure 2:
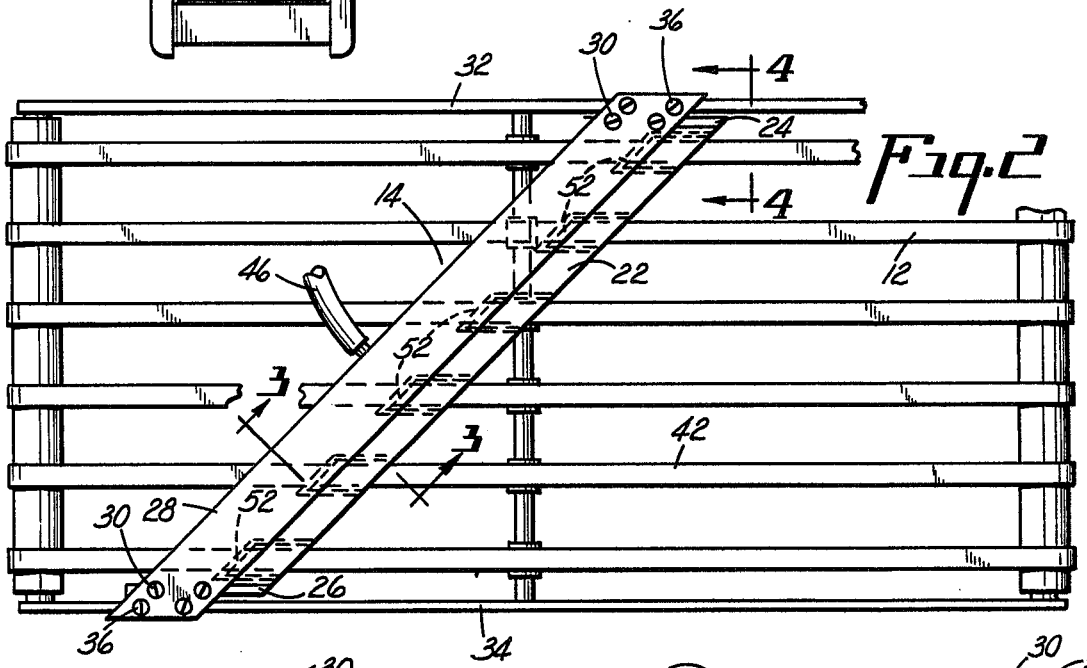
FIG. 2 is a plan view, on an enlarged scale, of a conveyor and the sheet turn-over device of FIG. 1.

The sheet turn-over device 14 comprises a semi-tubular member 22 mounted between a pair of end walls 24 and 26 and secured thereto as by soldering or the like. The end walls 24 and 26 are secured to a mounting bracket 28 with screws 30, and the bracket 28 is secured to conveyor side plates 32 and 34 with screws 36. As shown in FIGS. 1 and 2, the semi-tubular member 22 is mounted on the conveyor 12 such that its axis intersects the first and the second paths and is normal to a bisector of the angle between the paths. The open face of the semi-tubular member 22 faces the printing couple 10 and the collator 18.

In the illustrated embodiment the axis of the semi-tubular member 22 forms an angle of 45° with each of the paths and the copy sheet is passed from the first to the second path at a right angle. However, the conveyors 12 and 16 may be positioned with respect to each other at angles within a range such that the first and the second paths are something other than normal to each other, e.g. from about 60° to about 120°, the only requirement being that the sheet turn-over device is so positioned that the axis of the semi-tubular member 22 is normal to the bisector of the angle between the paths. For the purpose of the present description and claims, this range of angles may be considered substantially normal, and is so referred to hereinafter.

Figure 3:
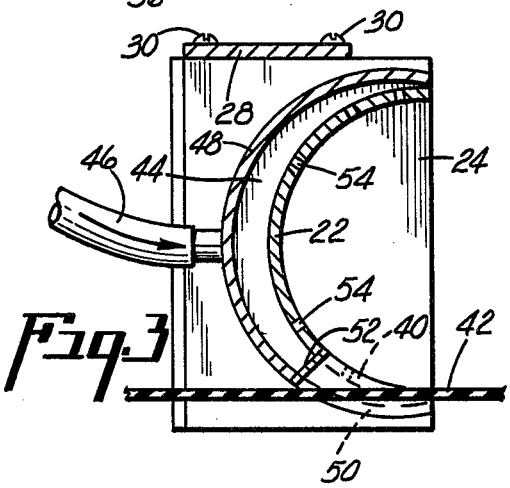
FIG. 3 is an enlarged section taken substantially on line 3—3 of FIG. 2.

In order for the conveyor 12 to advance the copy sheet up and into the sheet turn-over device 14, and to continue to advance the sheet as it is being inverted by the semi-tubular member 22, the lower edge of the member 22 is provided with a series of clearance openings 40 for the passage therethrough of endless belts such as the belt 42 shown in FIG. 3. In this way the lower or lead edge of the semi-tubular member 22 is positioned below the plane of the belts so that the sheet is unobstructed in its advancement into and around the inside curved surface of the semi-tubular member 22 for inverting the sheet and directing it to the conveyor 16. As the sheet is being advanced by the conveyor belts 42 and inverted by the turn-over device 14, the sheet exits at the upper edge of the semi-tubular member 22 and falls by gravity onto the conveyor 16 for transport to the sheet distributor 18.

The present invention also provides an air blower means to prevent undue frictional contact of the sheet against the sheet turn-over device and to avoid streaking the printed image in case the sheet should be printed on both sides as will be discussed below. As shown in FIG. 3 there is provided a plenum 44, associated with the sheet turn-over device 14, for receiving a supply of compressed air. The air is supplied to the plenum 44 by an inlet conduit 46 connected to a suitable source of compressed air not shown in the drawing. The plenum 44 comprises a curved wall 48 positioned behind and spaced from the semi-tubular member 22. The curved wall 48 is also mounted between the end walls 24 and 26 and is secured thereto as by soldering or the like to provide a closed chamber.

The lower edge of the curved wall 48 is also provided with clearance openings 50 for the passage of the endless belts therethrough, as shown in FIG. 3, and the lower edge is also positioned below the plane of the belts in the same way as the lower edge of the semi-tubular member 22. To prevent leakage of compressed air from the plenum in the areas of the clearance openings 40 and 50, there is provided at each of the clearance openings a U-shaped member 52 which encloses the sides of the openings and extends between the semi-tubular member 22 and the curved wall 48. These U-shaped members 52 may also be secured in place as by soldering or the like.

Figure 4:
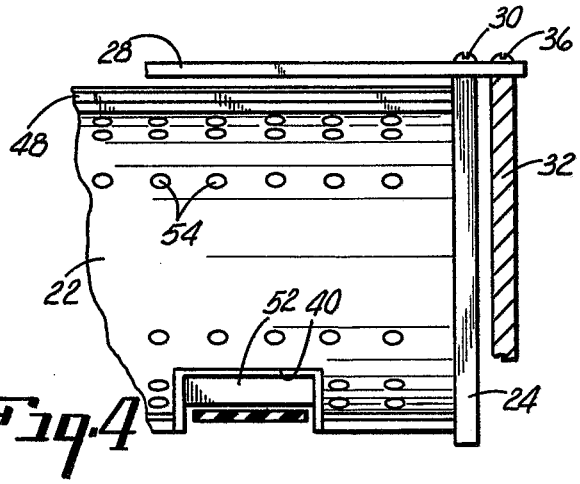
FIG. 4 is an enlarged section taken substantially on line 4—4 of FIG. 2.

As shown in FIGS. 3 and 4, the semi-tubular member 22 is provided with a plurality of holes 54 communicating with the plenum 44. Thus, as the copy sheet enters the semi-tubular member 22, the holes 54 direct controlled jets of air against the sheet to thereby prevent the sheet from rubbing or dragging against the semi-tubular member as it passes around the inner surface of the member 22, to avoid smudging and smearing of the printed image on a sheet printed on both sides.

In conventional sheet duplicating and collating applications the printing couple and the collator are arranged in tandem and the duplicated copy sheet is delivered in a straight path, printed-face-up, from the printing couple to a pocket of the collator. If all of the duplicating masters, comprising a complete set or packet of material to be printed and collated, are available to the machine operator at the start of the operation, the operator may proceed by running the last master (last page of the collated set) first and continuing in reverse order such that the first master (page one of the collated set) is run last. In this way each set of collated sheets in the pockets is stacked in proper numerical order when removed from the collator.

In many instances all of the masters are not available at the start of the run and the masters are furnished to the operator in a piecemeal fashion, as they are completed. In such situations the sheets are duplicated in consecutive numerical order starting with the first master (page 1 of the set) and, as additional masters of the set are made available, continuing through the last master. However, because the conventional equipment the copy sheets are not inverted after printing and prior to delivery to the collator, the sheets are delivered to the pockets and stacked one on top of the other in reverse order such that the last page of the set is deposited printed-face-up at the page one position at the top of the stack, and the first or page one of the collated set is printed-face-up and is positioned at the last page position at the bottom of the stack. Therefore, it is necessary to manually rearrange each of the collated sets to place the sheets therein in sequential numerical order.

In the operation of the device of the present invention, the masters are run in consecutive order starting with page one and continuing through the last master of the set. Each copy sheet printed on the printing couple 10 is advanced, printed-face-up, by the conveyor 12 to the sheet turn-over device 14. As the lead end of the sheet enters the sheet turn-over device it is guided around the curved surface of the semi-tubular member 22 which progressively inverts the sheet as it continues to be advanced by the conveyor 12. Because of the angular position of the sheet turn-over device with respect to the conveyors 12 and 16, which in this case are normal to each other, as the sheet is being inverted it is also directed from the conveyor 12 and onto the conveyor 16 which advances the sheet, printed-face-down, to a pocket 20 of the sheet distributor device 18. The sheet is received in the pocket 20 lead end first with its printed-face-down and subsequent sheets are delivered to the pocket in the same way, printed-face-down, and stacked one on top of the other to produce a set of collated sheets. Thus, when the set of collated sheets is removed from the pocket, and the stack is turned over or printed-face-up, all of the sheets from the first through the last page are in proper sequential order because the sheets were printed in consecutive order and inverted prior to deposit of the sheets in the pocket.

While the foregoing description deals primarily with printing on a single face of a copy sheet before collating, it will be understood that there are conventional duplicating machines which include two tandem printing couples between which is provided a sheet inverter of the conventional end-over-end type, arranged to print first on one face of the copy sheet and then the other. When such a machine is equipped with a master for page 1 (i.e. odd numbered pages) on the first printing couple and a master for page 2 (i.e. even numbered pages) on the second printing couple, the sheets as they issue will be already face down for collating in finished order.

It can be seen, however, that such a machine can be used very conveniently either to print single impression sheets or sheets printed on two faces, if installed in combination with the sheet handling mechanism of the present invention together with a sheet collating device. In the first case, if the first head is idled and the printing takes place on the second head, collating occurs exactly as was described above for a duplicator with a single printing couple. However, if it is desired to use the same machine in a dual printing mode for printing on both sides of the sheets, then all that is required is to install the master for page 2 (i.e. the even numbered pages) on the first printing couple and the master for page 1 (i.e. the odd numbered pages) on the second printing couple, in which case the first sheets will issue with page 2 facing up and be inverted by the sheet turn-over device 14 on the way to the collator. There is, accordingly, still no requirement in either mode that the operator basically reverse the series of masters and start with the final page.

When a dual printing duplicator forms part of the combination as just described, of course, the air issuing from the plenum 44 via holes 54 not only prevents frictional contact of the sheets with the guiding surfaces but also minimizes the chance for smudging of whichever printed face is turned towards the surface when both faces carry impressions.

From the foregoing, it will be appreciated that the present invention provides certain distinct advantages over known devices for printing and collating copy sheets and, also, for handling sheets to be printed on both sides.

The sheet turn-over device of the present invention provides for passing copy sheets from a first path to a second path substantially normal to the first path and also inverting the copy sheets. Even though the copy sheets travel at high speed and in closely spaced relation, the device handles the copy sheets without danger of interference between adjacent sheets which might result in jamming and still satisfies the important and practical economic and space requirement restrictions.

Further, because the printing couple and the collator may be arranged in an L-configuration, the equipment is more compact than conventional tandem arrangements and provides the machine operator greater accessibility to various controls and operations to be performed during machine operation.

What is claimed is:

1. A duplicating machine including a printing couple for applying a lithographic ink image to one face of a flexible cut sheet and having a first sheet path in a predetermined direction, and a collator for receiving printed sheets after they issue from the printing couple and having a second path substantially normal to the first path, a sheet handling device for moving the sheet along the first path, inverting the sheet and then moving it along the second path, comprising:

a belt conveyor for moving the sheet along the first path;

a sheet turnover device comprising a semi-tubular member having an axis intersecting the first and the second paths and normal to a bisector of the angle between the paths, said semi-tubular member including a concave sheet guide surface facing the paths and free of any mating guide surfaces;

a lower entrance edge on the semi-tubular member positioned at a level below the first path for receiving the sheet and directing it upwardly towards an upper exit edge of the semi-tubular member to progressively invert the sheet as it is advanced in the first path and simultaneously direct the sheet from the first to the second path, the sheet being transported by gravity from the upper exit edge of the semi-tubular member to the second path;

wall means positioned behind the sheet guide surface of the semi-tubular member and spaced therefrom for providing a plenum for receiving a supply of compressed air, said wall means having a bottom edge adjacent the lower entrance edge of the semi-tubular member;

means for supplying the plenum with compressed air;

a plurality of perforations in the semi-tubular member in communication with the plenum for directing controlled amounts of compressed air against the sheet as it traverses the sheet guide surface of the semi-tubular member;

clearance opening means provided in the bottom and the lower entrance edges for receiving the belt conveyor to permit unobstructed advancement of the sheet into and around the inside of the sheet guide surface of the semi-tubular member; and conveyor means for receiving the sheet as it leaves the upper exit edge of the sheet guide surface of the semi-tubular member and transporting it along said second path;

whereby sheets having surface conditions such as partially dried ink images as a result of an image applied thereto by the printing couple, which make necessary minimum rubbing contact during transport, can be successfully handled.

* * * * *